US007254363B2

(12) United States Patent
Nakamura et al.

(10) Patent No.: US 7,254,363 B2
(45) Date of Patent: Aug. 7, 2007

(54) IMAGE-FORMING PROCESS AND IMAGE-FORMING APPARATUS USING FLASH FUSING

(75) Inventors: Yasushige Nakamura, Ebina (JP); Yoshimichi Katagiri, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 158 days.

(21) Appl. No.: 11/059,558

(22) Filed: Feb. 17, 2005

(65) Prior Publication Data

US 2006/0018688 A1 Jan. 26, 2006

(30) Foreign Application Priority Data

Jul. 22, 2004 (JP) ..... 2004-214422

(51) Int. Cl.
*G03G 15/20* (2006.01)

(52) U.S. Cl. ..... 399/336; 399/337

(58) Field of Classification Search ..... 399/336, 399/337

See application file for complete search history.

(56) References Cited

U.S. PATENT DOCUMENTS

| | | | | |
|---|---|---|---|---|
| 4,699,863 | A | 10/1987 | Sawatari et al. | |
| 6,587,665 | B2 * | 7/2003 | Bartscher et al. | 399/336 |
| 2002/0136574 | A1 | 9/2002 | Bartscher et al. | |
| 2002/0146631 | A1 * | 10/2002 | Nakamura et al. | 430/109.4 |
| 2003/0049553 | A1 | 3/2003 | Nakamura et al. | |
| 2003/0186143 | A1 | 10/2003 | Katagiri et al. | |
| 2003/0186148 | A1 * | 10/2003 | Nakamura et al. | 430/107.1 |
| 2003/0203304 | A1 | 10/2003 | Katagiri et al. | |
| 2005/0208397 | A1 * | 9/2005 | Nakamura et al. | 430/45 |

FOREIGN PATENT DOCUMENTS

| | | |
|---|---|---|
| DE | 101 46 271 A1 | 11/2002 |
| JP | A 60-57858 | 4/1985 |
| JP | A 60-63545 | 4/1985 |
| JP | A 60-131544 | 7/1985 |
| JP | A 61-132959 | 6/1986 |
| JP | A 6-348056 | 12/1994 |
| JP | A 7-191492 | 7/1995 |
| JP | A 10-39535 | 2/1998 |
| JP | A 11-38666 | 2/1999 |
| JP | A 11-65167 | 3/1999 |
| JP | A 11-125930 | 5/1999 |
| JP | A 2000-35689 | 2/2000 |
| JP | A 2000-147824 | 5/2000 |
| JP | A 2000-155439 | 6/2000 |
| JP | A 2002-174924 | 6/2002 |
| JP | A 2003-295496 | 10/2003 |
| JP | A 2003-295497 | 10/2003 |

* cited by examiner

*Primary Examiner*—David M. Gray
*Assistant Examiner*—Ryan Gleitz
(74) *Attorney, Agent, or Firm*—Oliff & Berridge, PLC

(57) ABSTRACT

An image-forming process for forming a full-color image including: forming a full-color toner image by supplying at least a cyan toner, a magenta toner, and a yellow toner onto a recording medium; and fixing the toner image on the recording medium by flash fusing, wherein each of the cyan toner, the magenta toner and the yellow toner contains an infrared absorbent, the cyan toner is supplied so that out of the cyan toner, the magenta toner and the yellow toner, the cyan toner is positioned in the uppermost layer in areas of the toner image where cyan toner is present, and the flash fusing is performed by a delayed light emission process wherein a plurality of flash lamps emit lights at a time interval.

22 Claims, 3 Drawing Sheets

IMAGE-FORMING PROCESS AND IMAGE-FORMING APPARATUS USING FLASH FUSING

CROSS-REFERENCE TO RELATED APPLICATION

This application claims priority under 35 USC 119 from Japanese Patent Application No. 2004-214422, the disclosure of which is incorporated by reference herein.

BACKGROUND OF THE INVENTION

1. Field of the Invention

The present invention relates to an image-forming process and an image-forming apparatus for forming a full-color toner image by supplying color toners onto a recording medium and then forming the full-color image by fixing the toner image formed on the recording medium by using a flash fusing device, either in an electrophotographic process, an electrostatic recording process, a magnetic recording process, or the like.

2. Description of the Related Art

In electrophotographic processes commonly employed in copying machines, printers, printing machines, and the like, images are generally formed in the following manner: the photoconductive insulator surface of a photoreceptor drum is first uniformly charged positively or negatively (in a charging step), and then an electrostatic latent image is formed according to image information by irradiating, for example, a laser beam onto the photoconductive insulator surface and thus partially removing the electrostatic charge on the insulator surface. The latent image is then converted to a visible toner image, for example, by applying fine particles of a developer called toner onto the latent image area retaining the electrostatic charge on the photoconductive insulator. Generally, the toner image obtained in this manner is transferred electrostatically onto a recording medium such as recording paper and then the toner image is fixed on the recording medium in order to produce printed matter.

Various solidification and fusion methods including fusion of the toner by application of heat and/or pressure and fusion of the toner by irradiation of light energy have been used for fixing the toner image after transfer, and flash fusing processes (also called flash fixing processes) utilizing light, which are advantageous compared with application of heat or pressure, are now attracting more attention.

That is, the flash fusing process, which demands no pressure for toner fixation, has an advantage that the resolution (reproducibility) of the toner image is less deteriorated in the fixing step because the image needs not be brought into contact (or pressurized) with, for example, a fixing roller. In addition, such a device allows printing immediately after it is turned on, because it demands no preheating of heat sources such as a fixing roller and thus eliminates the waiting time for the heat sources to be preheated to a desired temperature after it is turned on. Elimination of the high-temperature heat sources is also advantageous in effectively preventing the rise in temperature of the device and in preventing the ignition of recording paper due to the heat from the heat sources even when the recording paper clogs in the fixing device due to system malfunction.

However, when color toners are used for fixing, the flash fusing process is rather lower in fixing efficiency than when a black toner is used, because of the lower light absorption efficiency of the color toners. Accordingly, many methods for improving the fixing efficiency by adding an infrared absorbent to the color toner have been proposed (e.g., Japanese Patent Application Laid-Open (JP-A) Nos. 60-63545, 60-57858, 60-131544, 61-132959, 6-348056, 7-191492, 10-39535, 11-38666, 11-65167, 11-125930, 2000-147824, 2000-155439, and 2000-35689). These proposed methods aimed at eliminating the problem of the deterioration in toner fusion properties and thus establishing well-balanced multicolor printing and flash fusing efficiencies, by adding to a toner a material absorbing light in the infrared region as an infrared absorbent. These methods also aimed at improving fixing efficiency by increasing the light intensity during flash fusing at the same time.

However, while the increase in the intensity of the light used for fixing leads to improvement in fixing efficiency it also causes printing defects; namely, "voids" formed in the toner image by evaporation of water and the like from the toner and the recording medium. It is therefore necessary to optimize the balance between the light intensity during image fixation and the toner fusion properties in order to satisfy both improved fixation and the margin for prevention of void generation. In particular if plural kinds of toners are superimposed and then fixed all at once by light, the increase in the amount of the toners applied onto a recording medium leads to a decline in toner fixing efficiency. Further an increase in the amount of toners deposited on a recording medium results in increase in the void generation rate during image fixation. It is more difficult to satisfy both favorable fixing efficiency and void resistance at the same time when the toner layer becomes thicker.

Alternatively, the order of superimposing the respective toner layers forming a full-color toner image has been investigated with a view to improving the flash fusing efficiency of toner. For example, a method of forming the top layer by using a yellow toner, which is usually lowest in fixing efficiency, has been proposed as the order of superimposing the toner layers (e.g., JP-A No. 2002-174924), but this condition is unfavorable because the fixing efficiency during multi-color printing deteriorates and use of an infrared absorbent in an increased amount for fixing the yellow toner results in turbid color. In addition, an increase in fixing light energy leads to an increased amount of voids, thus prohibiting favorable fixation and getting the enough margin for the void prevention.

Alternatively, the photoacoustic spectrometric (PAS) intensity of a light having a wavelength in the range of 800 to 2,000 nm has been investigated (e.g., JP-A Nos. 2003-295496 and 2003-295497). In these disclosures, it was proposed that a light having a higher PAS intensity should be irradiated to the top-layer toner during flash fixation. However, the intensities of the toners absorbing a flash light differ significantly depending on the colorants used: cyan, magenta, or yellow. For example, if a cyan pigment absorbing the light in a greater amount is used, the fixing efficiency of the image is higher even when it is irradiated with a light having a lower PAS intensity. The fixing efficiency of the toner image therefore could not necessarily be discussed only in relation to the PAS intensity. Further, generation of the voids and deterioration in the surface smoothness of fixed images remains even when using this method.

SUMMARY OF THE INVENTION

The present invention is accomplished in view of the above circumstances. The invention provides an image-forming process and an image-forming apparatus for forming a full-color image that satisfies both fixing efficiency and void resistance, which are normally incompatible with each other, at a sufficiently high level and is superior in color reproducibility, glossiness, and the like, by forming a full-color toner image by supplying color toners onto a recording medium and fixing the toner image onto the recording medium using a flash fusing device.

A first aspect of the invention is an image-forming process for forming a full-color image comprising: forming a full-color toner image by supplying at least a cyan toner, a magenta toner and a yellow toner onto a recording medium; and fixing the toner image on the recording medium by flash fusing, wherein: each of the cyan toner, the magenta toner and the yellow toner contains an infrared absorbent; the cyan toner is supplied so that out of the cyan toner, the magenta toner and the yellow toner, the cyan toner is positioned in an uppermost layer in areas of the toner image where the cyan toner is present; and the flash fusing is performed by a delayed light emission process wherein a plurality of flash lamps emit lights at a time interval.

A second aspect of the invention is an image-forming process for forming a full-color image comprising: forming a full-color toner image by supplying at least a cyan toner, a magenta toner and a yellow toner onto a recording medium; and fixing the toner image on the recording medium by flash fusing, wherein: each of the cyan toner, the magenta toner and the yellow toner contains an infrared absorbent; the yellow toner is supplied so that out of the cyan toner, the magenta toner and the yellow toner, the yellow toner is positioned in a lowermost layer in areas of the toner image where the yellow toner is present; and the flash fusing is performed by a delayed light emission process wherein a plurality of flash lamps emit lights at a time interval.

A third aspect of the invention is an image-forming apparatus for forming a full-color image, comprising: a toner image-forming device for forming a full-color toner image by supplying at least a cyan toner, a magenta toner and a yellow toner onto a recording medium; and an image fixing device for fixing the toner image on the recording medium by flash fusing, wherein: each of the cyan toner, the magenta toner and the yellow toner contains an infrared absorbent; the toner image-forming device supplies the toners so that out of the cyan toner, the magenta toner and the yellow toner, the cyan toner is positioned in an uppermost layer in areas of the toner image where the cyan toner is present; and the image fixing device is a flash fusing device having a plurality of flash lamps capable of flash fusing by a delayed light emission process of emitting lights from the plurality of flash lamps at a time interval.

A fourth aspect of the invention is an image-forming apparatus for forming a full-color toner image, comprising: a toner image-forming device for forming a full-color toner image by supplying at least a cyan toner, a magenta toner and a yellow toner onto a recording medium; and an image fixing device for fixing the toner image on the recording medium by flash fusing, wherein: each of the cyan toner, the magenta toner and the yellow toner contains an infrared absorbent; the toner image-forming device supplies the toners so that out of the cyan toner, the magenta toner and the yellow toner, the yellow toner is positioned in a lowermost layer in areas of the toner image where the yellow toner is present; and the image fixing device is a flash fusing device having a plurality of flash lamps capable of flash fusing by a delayed light emission process of emitting lights from the plurality of flash lamps at a time interval.

DETAILED DESCRIPTION OF THE INVENTION

Figure 1:
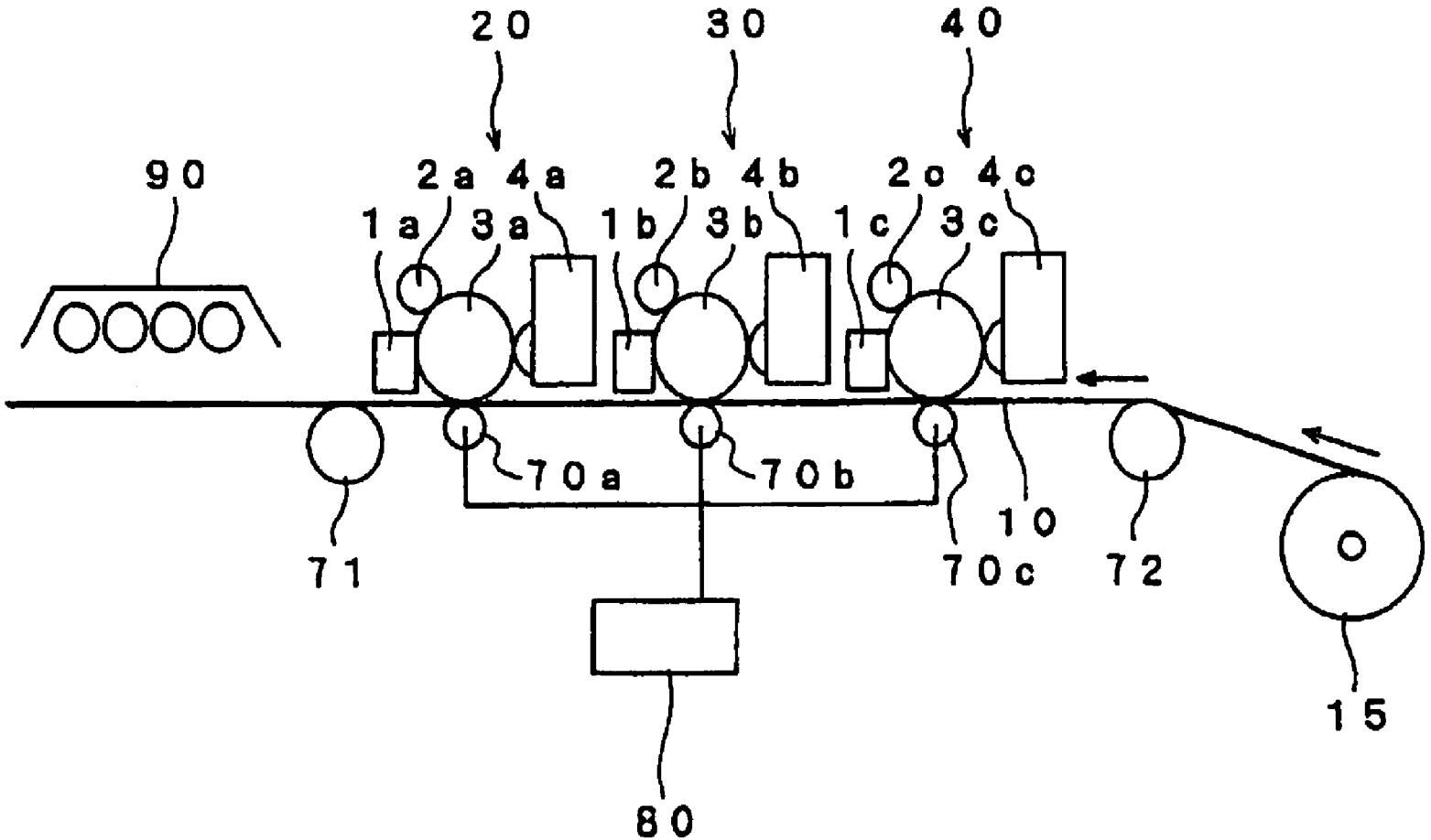
FIG. 1 is a schematic diagram illustrating an example of the image-forming apparatus according to the invention.

Hereinafter, the present invention will be described in detail.

Image-Forming Process

The first image-forming process according to the invention is an image-forming process for forming a full-color image including forming a full-color toner image by using at least the three color toners of cyan toner, magenta toner, and yellow toner and supplying each toner onto a recording medium, and then fixing the toner image on the recording medium by flash fusing, wherein each of the three color toners contains an infrared absorbent, the cyan toner is supplied such that out of the three color toners the cyan toner is positioned in the uppermost layer in areas of the toner image including cyan toner, and the flash fusing is performed by a delayed light emission process wherein multiple flash lamps emit lights at a time interval.

In addition, the second image-forming process according to the invention is an image-forming process for forming a full-color image similar to the first image-forming process, wherein each of the three color toners contains an infrared absorbent, the yellow toner is supplied such that out of the three color toners the yellow toner is positioned in the lowermost layer in areas of the toner image including yellow toner, and the flash fusing is performed by a delayed light emission process wherein multiple flash lamps emit lights at a time interval.

In this process, in addition to flash fixation, a medium such as paper may be preheated or postheated, for example, by a halogen lamp, an oven, or the like as a supplementary measure.

Namely in the invention, it was found that when a full-color image is formed by using at least the three color toners of cyan toner, magenta toner and yellow toner, it was possible to increase the fixing efficiency and the void margin and also to provide a full-color image with superior color, glossiness, and the like, by positioning the cyan toner in the uppermost layer out of the three color toners in areas of the toner image including cyan toner, positioning the yellow toner in the lowermost layer out of the three color toners in areas of the toner image including yellow toner, and further performing flash fusing by a delayed light emission process.

"Void" generation is a printing defect specific to flash fusing, involving a phenomenon whereby part of the toner image is damaged by bumping of water in the toners and the recording paper during fixation, leaving the defect of an eroded surface.

The properties described above can be obtained for the following reasons.

When the ease of fixing of a cyan toner, a magenta toner, and a yellow toner are compared, the cyan toner has higher fixing efficiency than the other 2 color toners because the cyan pigment absorbs light having a wavelength of around 600 nm, and thus has a higher photothermal converting capacity for absorbed light. In contrast, the yellow toner is less effective in photothermal conversion because the pigment absorbs light having a wavelength of around 400 nm and the fixing efficiency of the yellow toner is inferior to the cyan toner even when the same amount of infrared absorbent is added. However, it is practically difficult to increase the amount of the infrared absorbent added to only the yellow toner, as this affects the color reproducibility of images far more significantly.

In addition, a black toner, which is a non-colored toner and which generally employs carbon black as the pigment, absorbs light in all regions from ultraviolet to infrared, and thus is higher in thermal conversion efficiency for absorbed light and exhibits a far higher fixing efficiency than those of color toners. Thus, the order in fixing efficiency of various toners under the same conditions is qualitatively as follows.

Fixing efficiency: (higher) black toner>>cyan toner>magenta toner>yellow toner (lower)

On the contrary, voids are generally formed in a greater number when the fixing efficiency is higher, and thus the order of void generation probability of various toners under the same conditions is qualitatively as follows.

Void generation probability: (Higher) black toner>>cyan toner>magenta toner>yellow toner (lower)

Because the infrared rays emitted from a flash lamp are rapidly weakened in toner during flash fusing, the fixing efficiency and void resistance of a toner image depend on the fixing efficiency and void resistance of the toner in the top layer (layer closest to the flash lamp) that is directly irradiated with the light during multi-color printing (fixation of multiple toner layers). Accordingly, it is extremely important to determine which color toner is used for the top layer, and the color toner highest in fixing efficiency should be used for the top layer for sufficient fixation of the image even when the toner layers are superimposed multiple times and thickly. On the other hand, it would be preferable to select the toner lowest in fixing efficiency among toners as the color toner for use in the bottom layer, because the fixing of the toner in this case needs to be considered only with respect to the bottom layer itself.

Thus, placing a cyan toner which is higher in fixing efficiency as the top layer can ensure a high fixing efficiency, while placing a yellow tone as the top layer sometimes results in an insufficient fixing efficiency. In other words, if three color toners in cyan, magenta and yellow are used, it is necessary to use a cyan toner as the top layer (first image-forming process) from among the color toners or a yellow toner as the bottom layer (second image-forming process), and it is more preferable to superimpose a cyan toner, a magenta toner, and a yellow toner in that order from the upper layer and below because such a structure is the highest in fixing efficiency and is favorable from the point of energy efficiency.

On the other hand, while the layer structure of the color toners in the order described above eliminates the problem of fixing efficiency, it does not avoid the problems of void generation (deterioration in void resistance) or deterioration in image quality. This is because the flash fusing of a layered full-color toner image including a cyan toner demands light energy of at least a certain level; and a single irradiation of the light energy onto the cyan toner in the top layer is inevitably accompanied by void generation as indicated by the higher void generation probability above and deterioration in the surface smoothness of the fixed image as described above.

In the invention, it was found that this problem might be solved by conducting the flash fusing by a delayed light emission process wherein flash lights from multiple flash lamps emit lights at a time interval. The delayed light emission process, which allows fractionated irradiations instead of a single irradiation, enables reduction in the emission energy (flash energy) of a single light irradiation and flash fusing under a milder fixing condition even when the same total light energy is applied to the toner image. In such a manner, it is possible to melt the cyan toner layer, i.e., the top layer, more gradually and consequently to prevent void generation, surface roughening of the fixed image, and the like.

As described above, in the invention, when the three toners are used as color toners, it is possible to obtain a favorable fixing efficiency, superior void resistance, and image quality at the same time in full-color image formation using flash fusing, by combining the order of respective toner layers constituting a full-color toner image and by performing the flash fusing by the delayed light emission process.

On the other hand, if a black toner is additionally used for toner image formation, it is important to decide where the layer of the black toner is placed, because the black toner, having a far larger light energy absorption efficiency than those of color toners, is higher in fixing efficiency but more susceptible to void generation as described above. Because the black toner is significantly different in fixing property and void resistance from color toners, the inventors have found that it was preferable to change the position of the black toner layer according to the intensity of emission energy.

When the flash energy is relatively lower at 1.0 J/cm$^2$ or more and less than 3.0 J/cm$^2$, wherein the black toner easily absorbing light is less active in void generation, it is preferable to supply the black toner so that it is placed as the top layer in areas of the toner image formed on a recording medium including black toner. In particular, when cyan, magenta, and yellow toners are used together with the black toner, it is most preferable to form a layer structure having the black toner as the top layer and then cyan, magenta, and yellow toners in that order from the second layer and below, from the viewpoints of satisfying the requirements of both fixing efficiency and void resistance and ensuring color reproducibility.

Alternatively, when the flash energy is relatively higher in the range of 3.0 to 7.0 J/cm$^2$, because a layer structure in which a black toner is placed as the top layer cannot prevent void generation, it is preferable to supply the black toner so that it is positioned as the bottom layer in areas of the toner image formed on a recording medium including black toner. In particular, when cyan, magenta, and yellow toners are used together with the black toner, it is preferable to use the cyan toner, the second highest in fixing efficiency among these toners, as the top layer and magenta toner, yellow toner, and black toner in that order from the second layer and below, from the viewpoints of satisfying the requirements of both fixing efficiency and void resistance and ensuring the color reproducibility.

Further, if an invisible toner, which is commonly used for prevention of forgery, is added to the toner image to be formed, it is preferable to place the invisible toner layer as the bottom layer below the yellow toner layer described above, because the invisible toner is normally lower in fixing efficiency than other color toners due to the absence of pigments therein that absorb light, even if the same amount of infrared absorbent is contained therein. For that reason, it is preferable to supply the toners so that the invisible toner becomes the bottom layer either in the image-forming method (first image-forming process) wherein a cyan toner is placed as the uppermost layer of the three color toners or in the image-forming method (second image-forming process) wherein a yellow toner is placed as the lowermost layer of the three color toners.

In particular, when the flash energy is 1.0 J/cm$^2$ or more, and less than 3.0 J/cm$^2$, and an invisible toner is used together with cyan, magenta, yellow, and black toners, it is most preferable to make the black toner the top layer and to use the cyan, magenta, yellow, and invisible toners in that order from the second layer and below, from the viewpoints of achieving both fixing efficiency and void resistance and ensuring color reproducibility. Alternatively, when the flash energy is in the range of 3.0 to 7.0 J/cm$^2$ and an invisible toner is used together with cyan, magenta, yellow and black toner, it is most preferable to make the cyan toner the top layer and to use the magenta, yellow, invisible, and black toners in that order from the second layer and below, from the viewpoints of achieving both fixing efficiency and void resistance and ensuring color reproducibility.

Examples of the light sources for use in the flash fusing according to the invention include common halogen lamps, mercury lamps, flash lamps, infrared lasers, and the like, and among them, instantaneous fixing by a flash lamp is most preferable for energy saving. The emission energy of the flash lamp is preferably in the range of 1.0 to 7.0 J/cm$^2$ and more preferably in the range of 2 to 5 J/cm$^2$.

The emission energy of a flash light per unit area, an indicator of the intensity of a xenon lamp strength, is represented by the following Formula (1):

$$S=((1/2)\times C\times V^2)/(u\times L)\times(n\times f) \quad (1)$$

In the Formula (1), n represents the number of the lamps lighted at the same time; f represents a lighting frequency (Hz); V represents an input voltage (V); C represents a condenser capacity (F); u represents a process traveling speed (cm/s); L represents the effective lighting width of the flash lamps (usually, the maximum paper width (cm)); and S represents an energy density (J/cm$^2$).

The flash fusing process according to the invention is a delayed process wherein multiple flash lamps are lighted at a time interval. The delayed process is a process of placing multiple flash lamps in a row, lighting the respective lamps at an interval of approximately 0.01 to 100 ms, and irradiating the same area of an toner image multiple times. In this manner, the process, which applies fractioned light energies, not all at once, but several times onto a toner image, makes the fixing condition milder and provides both superior void resistance and fixing efficiency.

When a toner image is irradiated with flash lights multiple times, the emission energy of the flash lamps indicates here in this specification means the total amount of the emission energies per unit area of respective flash lights.

In the invention, the number of the flash lamps is preferably in the range of 1 to 20 and more preferably in the range of 2 to 10. Additionally, the time interval between the multiple flash lamp lighting is preferably in the range of 0.1 to 20 msec and more preferably in the range of 1 to 3 msec.

Yet additionally, the emission energy of single flash lamp lighting is preferably in the range of 0.1 to 1 J/cm$^2$ and more preferably in the range of 0.4 to 0.8 J/cm$^2$.

Any known binder resins, various colorants, or the like may be added in the toner according to the invention. The primary component of such binder resins is preferably polyester or polyolefin, but copolymers of styrene and acrylic acid or methacrylic acid, polyvinyl chloride, phenol resins, acrylic resins, methacrylic resins, polyvinyl acetate, silicone resins, polyester resins, polyurethane, polyamide resins, furan resins, epoxy resins, xylene resins, polyvinyl butyral, terpene resins, coumarone indene resins, petroleum resins, polyether polyol resins and the like may be used alone or in combination of two or more. Use of a polyester resin or a norbornene polyolefin resin is preferable from the points of durability, transparency, and the like.

The glass transition temperature (Tg) of the binder resin for use in the toner is preferably in the range of 50 to 70° C.

In addition, a colorant suitably selected according to the color of the toner may be used.

Examples of the colorants for the cyan toner include cyan pigments including C.I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, and 180; C.I. Vat Cyan 1, 3, and 20, iron blue, cobalt blue, alkali blue lake, phthalocyanine blue, nonmetal phthalocyanine blue, partially chlorinated phthalocyanine blue, Fast Sky Blue, and Indanthren Blue BC; and cyan dyes including C.I. Solvent Cyan 79 and 162; and the like. Among them, C.I. Pigment Blue 15:3 is effective.

Examples of the colorants for magenta toner include magenta pigment such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, and 209, and Pigment Violet 19; magenta dyes such as C.I. Solvent Red 1, 3, 8, 23, 24, 25, 27, 30, 49, 81, 82, 83, 84, 100, 109, and 121, C.I. Disperse Red 9, C.I. Basic Red 1, 2, 9, 12, 13, 14, 15, 17, 18, 22, 23, 24, 27, 29, 32, 34, 35, 36, 37, 38, 39, and 40; Bengala, cadmium red, red lead, mercury sulfide, cadmium, Permanent Red 4R, Lithol Red, pyrazolone red, watching red, calcium salts, Lake Red D, Brilliant Carmine 6B, eosin lake , Rotamine Lake B, alizarin lake, Brilliant Carmine 3B, and the like.

In addition, examples of the colorants for yellow toner include yellow pigments such as C.I. Pigment Yellow 2, 3, 15, 16, 17, 97, 180, 185, and 139; and the like.

Further, examples of the colorants for black toner include carbon black, activated carbon, titan black, magnetic powder, Mn-containing nonmagnetic powder, and the like.

On the other hand, use of the coloring agents above should be avoided for the invisible toner higher in transparency.

The addition amount of each of the coloring agents above is preferably in the range of 1 to 20 parts by mass, with respect to 100 parts by mass of the toner particle prepared after blending with a binder resin and the like.

The infrared absorbent added to the toner according to the invention is a material having at least one or more strong light absorption peaks at a wavelength in the near-infrared region, i.e., in the range of 800 to 2000 nm, and may be an organic or inorganic substance.

Typical examples thereof include any known infrared absorbents, including cyanine compounds, merocyanine compounds, benzene thiol-based metal complexes, mercaptophenol-based metal complexes, aromatic diamine-based metal complexes, diimmonium compounds, aminium compounds, nickel complex compounds, phthalocyanine compounds, anthraquinone compounds, naphthalocyanine compounds, and the like.

More specific examples thereof include nickel metal complex-based infrared absorbents (trade name: SIR-130 and SIR-132, manufactured by Mitsui Chemicals), bis (dithiobenzyl)nickel (trade name: MIR-101, manufactured by Midori Kagaku Co. Ltd.), nickel bis(1,2-bis(p-methoxy phenyl)-1,2-ethylenedithiolate) (trade name: MIR-102, manufactured by Midori Kagaku Co. Ltd.), tetra-n-butylammonium nickel bis(cis-1,2-diphenyl-1,2-ethylene dithiolate) (trade name: MIR-1011, manufactured by Midori Kagaku Co. Ltd.), tetra-n-butylammonium nickel bis(1,2-bis(p-methoxyphenyl)-1.2-ethylenedithiolate) (trade name: MIR-1021, manufactured by Midori Kagaku Co. Ltd.), tetra-n-butyl ammonium nickel bis(4-tert-1,2-butyl-1,2-dithiophenolate) (trade name: BBDT-NI, manufactured by Sumitomo Seika Chemicals Co.), cyanine-based infrared absorbents (trade name: IRF-106 and IRF-107, manufactured by Fuji Photo Film Co. Ltd.), a cyanine-based infrared absorbent (trade name YKR2900, manufactured by Yamamoto Chemicals Inc.), aminium-based infrared absorbent and diimmonium-based infrared absorbent (trade name: NIR-AM1 and IM1, manufactured by Nagase ChemteX Corp.), immonium compounds (trade name: CIR-1080 and CIR-1081, manufactured by Japan Carlit Co.), aminium compounds (trade name: CIR-960 and CIR-961, prepared by Japan Carlit Co.), an anthraquinone compound (trade name: IR-750, manufactured by Nippon Kayaku), aminium compounds (trade name: IRG-002, IRG-003, and IRG-003K, manufactured by Nippon Kayaku), a polymethine compound (trade name: IR-820B, manufactured by Nippon Kayaku), diimmonium compounds (trade name: IRG-022 and IRG-023, manufactured by Nippon Kayaku), cyanin compounds (trade name: CY-2, CY-4, and CY-9, manufactured by Nippon Kayaku), a soluble phthalocyanine (trade name: TX-305A, manufactured by Nippon Shokubai Co., Ltd.), naphthalocyanines (trade name: YKR5010, manufactured by Yamamoto Chemicals Inc. and sample 1 manufactured by Sanyo Color Works Ltd.), inorganic materials (trade name: Ytterbium UU-HP, manufactured by Shin-Etsu Chemical and indium tin oxide, manufactured by Sumitomo Metal Industries, Ltd.), and the like.

Among these infrared absorbents, naphthalocyanine-based and aminium- or diimmonium-based infrared absorbents are preferable from the points of environmental safety, color tone, and the like. Dithiol-based nickel complexes are preferable in improving color tone, but higher in toxicity including carcinogenicity, and thus disadvantageous in use in toner. Ytterbium oxide and ytterbium phosphate almost white in color are preferable as the infrared absorbent for the invisible toner.

These infrared absorbents may be used in combination of two or more. Such a combined use is more effective, as the infrared ray-absorbing region expands and thus the fixing efficiency improves. The amount of the infrared absorbent added is preferably in the range of 0.05 to 5 parts if it is an organic substance and in the range of 5 to 70 parts by mass if it is an inorganic substance, with respect to 100 parts by mass of toner particle. When the absorbent is an organic substance, an amount of less than 0.05 part by mass often results in insufficient fixing of toner, while an amount of more than 5 parts by mass may result in a turbid color that cannot be practically used. Alternatively, when the infrared absorbent is an inorganic material, the absorbent is colored relatively faintly and thus may be used in a greater amount, but has a lower light absorption capacity, and should be added in a greater amount than that of an organic substance. An addition amount of less than 5 parts by mass may result in insufficient fixing of toner, while an addition amount of more than 50 parts by mass may also result in insufficient fixing of the toner due to decrease in the fixing efficiency of binder resin.

In the invention, it is also preferable to reduce the maximum absorbance in the light absorption region of the cyan toner to lower than the maximum absorbances of magenta and yellow toners for improving both fixing efficiency and void resistance more effectively as will be described below; and for that reason, it is preferable that the content amount of the infrared absorbent in the cyan toner is smaller than the respective content amounts of the infrared absorbent in the magenta toner and the yellow toner.

In addition, an antistatic agent or a wax may be added to each of the toners as needed.

Examples of the antistatic agents include known calixarenes, nigrosin-based dyes, quaternary ammonium salts, amino group-containing polymers, metal-containing azo dyes, salicylic acid complex compounds, phenol compounds, azo chromium compounds, azo zinc compounds, and the like. In addition, a magnetic toner containing a magnetic material such as iron powder, magnetite, ferrite, or the like may be used as the toner. In particular, a white magnetic powder may be used for color toners.

The most preferable waxes for use in the toner according to the invention include ester waxes, polyethylene, polypropylene, and copolymers of polypropylene and polypropylene; and additionally, polyglycerin waxes, microcrystalline waxes, paraffin waxes, carnauba waxes, sazol wax, montanic acid ester waxes, deacidified carnauba waxes, unsaturated fatty acids such as palmitic acid, stearic acid, montanic acid, brassidic acid, eleostearic acid, and vernolic acid; saturated alcohols such as stearyl alcohol, aralkyl alcohols, behenyl alcohol, carnaubyl alcohol, ceryl alcohol, mericyl alcohol, and long-chain alkyl alcohols having a further longer-chain alkyl group; polyhydric alcohols such as sorbitol; fatty amides such as linoleic amide, oleic amide, and lauric amide; saturated fatty acid bisamides such as methylene bisstearic amide, ethylene biscaprinic amide, ethylene bislauric amide, and hexamethylene bisstearic amide; unsaturated fatty amides such as ethylene bisoleic amide, hexamethylene bisoleic amide, N,N'-dioleyl adipic amide, and N,N'-dioleyl sebacic amide; aromatic bisamides such as m-xylene bisstearic amide and N,N'-distearyl isophthalic amide; fatty acid metal salts (generally called metal soaps) such as calcium stearate, calcium laurate, zinc stearate, and magnesium stearate; aliphatic hydrocarbon waxes grafted with a vinyl monomer such as those of styrene, acrylic acid, or the like; partially esterified compounds prepared from a fatty acid and a polyhydric alcohol such as behenic acid monoglyceride; hydroxyl group-containing methyl ester compounds obtained by hydrogenation of a vegetable oil; and the like.

The wax material for use in the toner preferably has an endothermic peak at a temperature of 50 to 90° C. as determined by differential calorimetric analysis (DSC analysis). The wax having an endothermic peak of lower than 50° C. may lead to blocking of the toner, while the wax of higher than 90° C. may lead to insufficient fixing. Use of an internally heating input-compensating differential scanning calorimeter higher in precision is preferable for the DSC analysis from the measuring principle.

Any one of commonly practiced blending and pulverizing methods, wet granulation methods, and the like may be used for production of the toners above. The wet granulation methods above include, for example, suspension polymerization method, emulsion polymerization method, emulsion polymerization coagulation method, soap-free emulsion polymerization method, nonaqueous dispersion polymerization method, in-situ polymerization method, interface polymerization method, emulsion dispersion granulation method, and the like.

In the blending and pulverizing method above, the toners are prepared by blending a binder resin, a wax, an antistatic agent, a pigment or dye as a colorant, a magnetic material, an infrared absorbent, and other additives sufficiently in a mixer such as HENSCHEL Mixer, ball mill, or the like; making the resins mutually solved by melt blending in a heated mixer such as heating roll, kneader, or extruder, and dispersing or solubilizing the metal compound, pigment, dye, magnetic material, and the like therein; solidifying by cooling and pulverizing the mixture; and classifying the resulting particles. Alternatively, master batches may be used for improvement in the dispersibility of the pigment and the infrared absorbent.

Further, the infrared absorbent may be adhered or fixed onto the surface of the color toner or the invisible toner instead of being added by dispersing in the color toner and invisible toner as described above.

Examples of the surface modification devices used for facilitating the surface adherence include surface modification devices wherein the toners are subjected to impact in a high-speed air flow such as Surfusing System (manufactured by Nippon Pneumatic Mfg. Co.), hybridization system (manufactured by Nara Machinery Co.), Kryptron Cosmo series products (manufactured by Kawasaki Heavy Industries), and surface modification devices whereto dry mechanomill method is applied such as Innomizer System (manufactured by Hosokawamicron), Mechanofusion System (manufactured by Hosokawamicron), and Mechanomill (manufactured by Okada Seiko Co.); surface modification device whereto a wet coating is applied such as Dispercoat (manufactured by Nissin Engineering) and Coatmizer (manufactured by Freund Co., Ltd.); and the like, and these devices may be used in combination as needed.

The volume-average particle diameter D50v of the toners prepared as described above is preferably in the range of 3 to 10 μm, more preferably in the range of 4 to 8 μm; and the ratio of the volume-average particle diameter D50v to the number-average particle diameter D50p (D50v/D50p) is preferably in the range of 1.0 to 1.25. Use of a toner having such a smaller particle diameter and uniformity in particle diameter enables prevention of fluctuation in the electrostatic property of the toner, reduction in fogging of the image formed, and improvement in the fixing efficiency of the toner. It also improves the thin line reproducibility and the dot reproducibility of the image formed.

In addition, the average circularity of each toner is preferably 0.955 or more, more preferably 0.960 or more, and the standard deviation of the circularity, 0.040 or less, more preferably 0.038 or less. In this manner, it is possible to superimpose each toner in a condensed state on a recording medium, making the thickness of the toner layer on the recording medium thinner and increasing the fixing efficiency thereof. In addition, uniformization of the toner shape contributes to reduction in the fogging and improvement in the thin line reproducibility and dot reproducibility of the image formed.

The toner average circularity (circular perimeter/actual perimeter) is calculated after determining the perimeter of the projected image of a particle in an aqueous dispersion system and the circumferential length (circular perimeter) of a circle having an identical area to the projected area of the toner particle by using a flow-type particle image analyzer (trade name: FPIA2000, manufactured by Sysmex Corp.).

On the other hand, if toner particles are prepared in a wet granulation method, the shape factor SF1 of the toner particle is preferably in the range of 110 to 135.

The toner shape factor SF1 is determined by sending the shape image or optical microscopic image of toner particles spread on a slide glass via a video camcorder into a LUZEX image-analyzing instrument; measuring the maximum lengths and the projected areas of 50 or more toner particles; and calculating according to the following Formula (2):

$$SF1=(ML^2/A)\times(\Pi/4)\times 100 \quad (2)$$

In Formula (2), ML represents the absolute maximum length of a toner particle, and A represents the projected area of the toner particle.

In addition, the volume particle size distribution index GSDv of the toner particle is preferably 1.25 or less.

The volume-average particle diameter, the particle diameter distribution indicator, and the like of the toner according to the invention are determined by using COULTER COUNTER TAII (manufactured by Beckmann-Coulter Inc.), and ISOTON-II (manufactured by Beckmann-Coulter) as the electrolyte. The count number is 50,000. The aperture diameter used is 100 μm.

Based on the particle size distribution thus determined, the volume and the number of toner particles in each of the particle size range (channel) previously partitioned are obtained and plotted from the smallest side, to give a cumulative distribution curve; and the particle diameters at a cumulative point of 16% are designated respectively as volume-average particle diameter D16v and number-average particle diameter D16p; and those at a cumulative point of 50%, as volume-average particle diameter D50v (representing the volume-average particle diameter of the toner described above) and the number-average particle diameter D50p. In the similar manner, the particle diameters at a cumulative point of 84% were designated respectively as volume-average particle diameter D84v and the number-average particle diameter D84p. The volume-average particle distribution index (GSDv) is calculated as a square root of 84v/D16v by using the values above.

White inorganic fine particles may be added to the toner according to the invention for improvement in fluidity and the like. The amount thereof blended to the toner particle is in the range of 0.01 to 5 parts by mass and preferably in the range of 0.01 to 2.0 parts by mass with respect to 100 parts by mass of the toner particle. Examples of the inorganic fine particles include silica fine powder, alumina, titanium oxide, barium titanate, magnesium titanate, calcium titanate, strontium titanate, zinc oxide, quartz sand, clay, mica, wollastonite, diatomaceous earth, chromium oxide, cerium oxide, bengala, antimony trioxide, magnesium oxide, zirconium oxide, barium sulfate, barium carbonate, calcium carbonate, silicon carbide, silicon nitride, and the like, and silica fine powder is particularly preferable. In addition, any other known materials such as silica, titanium, resin fine powders, alumina, and the like may be used additionally. Further, a metal salt of a higher fatty acid represented by zinc stearate or fine particle powders of a fluorochemical polymer may be added thereto as a cleaning activator.

The toner according to the invention can be prepared by blending the inorganic fine particles above and desired additives as needed sufficiently in a mixer such as a HENSCHEL mixer or the like.

Among the color toners according to the invention, the maximum value of infrared ray absorbance of the cyan toner in a wavelength region of 800 to 1,100 nm is preferably smaller than the respective maximum values of infrared ray absorbance of the yellow toner and magenta toner in the wavelength region of 800 to 1,100 nm. In such a case, the decrease in the infrared ray absorption of the cyan toner in the 800 to 1,100 nm region is compensated by an increase in visible light absorption in the 600 to 800 nm region. In this manner, the total of the infrared ray absorption and the visible light absorption of each toner in the 600 to 1,100 nm region becomes almost at the same level, consequently leading to an well-balanced fixing efficiency and void resistance of the cyan, magenta, and yellow toners.

The absorbance of the toners is determined by a reflection method in a spectrophotometer (trade name: U-4100, manufactured by Hitachi) by filling the toners into a quartz cell (trade name: PSH-001, dimension: 3.4×2.0×4.8 cm). The "absorbance" is a value represented by $\log_{10}(I_0/I)$ when the incident light intensity is designated as $I_0$ and the penetrated light intensity as I. Alternatively, the emission spectrum intensity of flash lamps is determined by using USR-40V (Ushio Inc.).

If the image-forming process according to the invention is an image-forming process in an electrophotographic process, the developer for electrophotography (hereinafter, abbreviated as "developer") may be a single-component developer including a toner or a two-component developer including a carrier and a toner.

The carrier for use in the two-component developer is, for example, a resin-coated carrier having a resin-coated layer on the core material surface. Examples of the core materials include known magnetite, ferrite, and iron powders. The coating agent for the carrier is not particularly limited; but silicone resin-based agents are particularly preferable.

The image-forming process according to the invention is not particularly limited as described above if it is capable of forming a full-color toner image on a recording medium by using toners including color toners, and preferable examples thereof include the following image-forming processes in an electrophotographic process.

A specific example of the image-forming process according to the invention include forming an electrostatic image on the surface of an electrostatic image-holding member; forming an toner image by developing the electrostatic image formed on the electrostatic image-holding member surface with a developer containing a toner; transferring the toner image formed on the electrostatic image-holding member. surface onto an image-receiving member surface; and fixing the toner image transferred on the recording medium surface to form an image on the recording medium surface. The developer used in the process is a developer containing the color toner described above.

Any one of the known processes practiced in conventional image-forming processes may be used in each of the steps above. If an intermediate transfer body or the like is not used, the image-receiving member represents a recording medium per se. In addition, the image-forming process according to the invention may include any steps other than the steps above, for example, a cleaning step for cleaning the latent image-bearing surface and the like.

When a photoreceptor for electrophotography is used as the electrostatic image-holding member, the image formation in the image-forming process according to the invention may be performed, for example, as follows: First, the surface of the photoreceptor for electrophotography is charged uniformly in a Corotron electrostatic charging device, a contact electrostatic charging device, or the like, and exposed to light, forming an electrostatic image. Then, a toner image is formed on the photoreceptor for electrophotography by bringing the photoreceptor into contact with or closer to a developing roll carrying a surface developer layer and thus adhering toner particles onto the electrostatic image. The toner image formed is then transferred onto the surface of an image-receiving medium such as paper by using a Corotron electrostatic charging device or the like. Further, the toner image transferred onto the recording medium surface is then fixed by using a fixing device, forming an image on the recording medium.

Typical examples of the photoreceptors for electrophotography include inorganic photoreceptors such as amorphous silicon and selenium; and organic photoreceptors using polysilane, phthalocyanine or the like as electric an charge-generating material ors an electric charge-transferring material, and an amorphous silicon photoreceptor is particularly preferable as it has a longer lifetime.

In addition, a flash fusing device (flash fixing device) employing the delayed light emission process described above is used as the fixing device.

The image-forming process according to the invention can be applied to a high-speed process, since images are fixed by flash fusing. The processing speed in the process according to the invention is preferably 200 mm/sec or more, more preferably 500 mm/sec or more, and still more preferably, 1,000 mm/sec or more.

Image-Forming Apparatus

An example of the image-forming apparatus according to the invention will be described below with reference to drawings.

Figure 2:
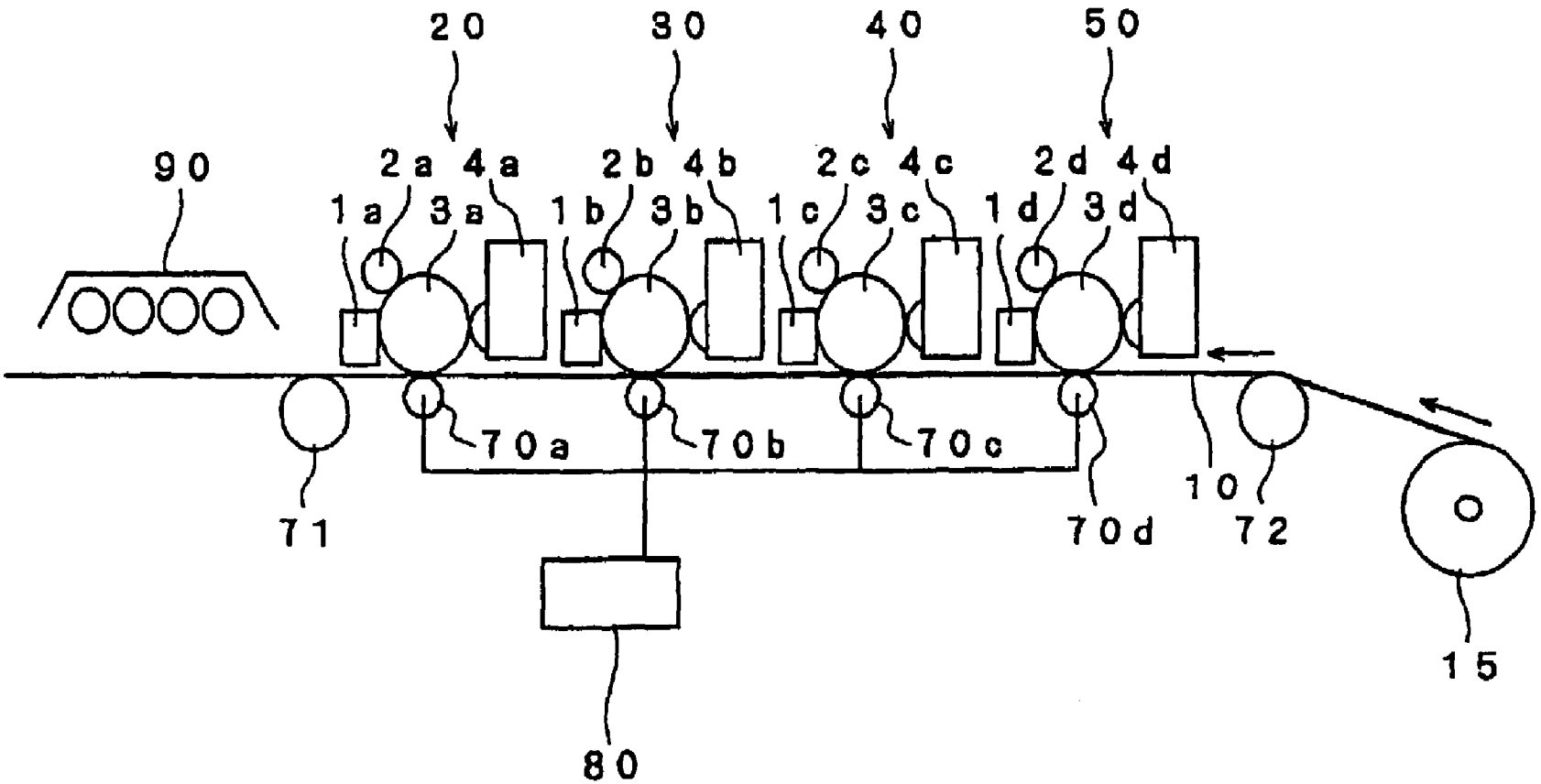
FIG. 2 is a schematic diagram illustrating another example of the image-forming apparatus according to the invention.
Figure 3:
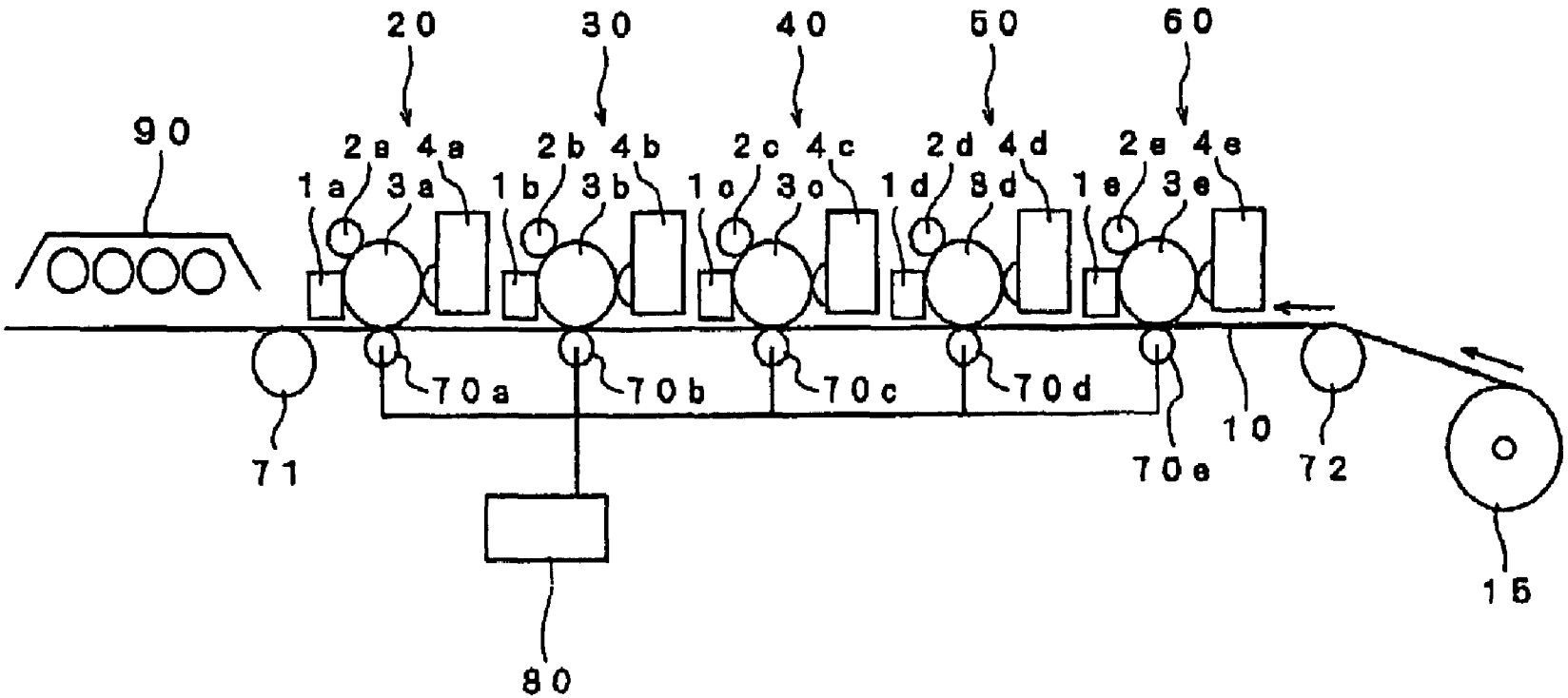
FIG. 3 is a schematic diagram illustrating yet another example of the image-forming apparatus according to the invention.

FIGS. 1 to 3 each are a schematic view illustrating an example of the image-forming apparatus according to the invention. FIG. 1 is a view of an apparatus forming a toner image by using three color toners in cyan, magenta, and yellow; FIG. 2, a view of an apparatus forming a toner image by using a black toner in addition to the three color toners above; and FIG. 3, a view of an apparatus forming a toner image by using an invisible toner in addition to the three color toners and the black toner.

Hereinafter, the structure and the operation of the three image-forming apparatuses will be described with reference to FIG. 1.

In FIGS. 1, 1*a* to 1*c* each represent an electrostatic charging device; 2*a* to 2*c*, an exposure apparatus; 3*a* to 3*c*, an electrostatic image-holding member (photoreceptor); 4*a* to 4*c*, a developing device; 10, a recording paper (recording medium) fed from a roll medium 15 in the arrow direction; 20, a cyan developing unit; 30, a magenta developing unit; 40, a yellow developing unit; 70*a* to 70*c*, a transfer device (transfer roller); 71 and 72, a roller, 80, a transfer voltage-supplying device; and 90, a flash fusing device.

The image-forming apparatus shown in FIG. 1 has developing units for toners different in color represented by 20, 30 and 40, each having an electrostatic charging device, an exposure apparatus, a photoreceptor, and a developing device; rolls 71 and 72 for conveying a recording paper 10 placed in contact with the recording paper 10; transfer rolls 70*a*, 70*b*, and 70*c* for pressing the recording paper 10 onto the photoreceptors of respective developing units that are placed on the other side of the recording paper with respect to the photoreceptor; a transfer voltage-supplying device 80 for supplying a voltage to the three transfer rolls (the above-mentioned are collectively called a toner image-forming device); and a flash fusing device 90 (fixing device) for irradiating a light onto the photoreceptor side of the recording paper 10 that is traveling through the nip areas between the photoreceptors and the transfer rolls in the direction indicated by the arrows in FIG. 1.

In the cyan developing unit 20 an electrostatic charging device 1*a*, an exposure apparatus 2*a*, and a developing device 4*a* are placed clockwise around a photoreceptor 3*a*. In addition, the transfer roll 70*a* is placed on the other side of the recording paper 10 so that transfer roll 70*a* comes into contact with the surface of the photoreceptor 3*a* via the recording paper 10 in the area between the position of the developing device 4*a* and the electrostatic charging device. Other developing units for toners different in color also have the same structure. In the image-forming apparatus according to the invention, the developing device 4*a* in the developing unit 20 is loaded with a developer containing the above-described cyan toner and the developing devices of the other developing units are respectively loaded with the toners for flash fusing corresponding to the respective other colors.

Image formation in the image-forming apparatus will be described below. First, the surface of the photoreceptor 3*c* is charged uniformly by the electrostatic charging device 1*c* while the photoreceptor 3*c* is rotated in the clockwise direction in the yellow developing unit 40. A latent image corresponding to the yellow component image of an original image to be copied is then formed on the surface of the photoreceptor 3*c*, by photoirradiation of the surface of the charged photoreceptor 3*c* by the exposure device 2*c*. Then, the latent image is further developed into a yellow toner image by application of the yellow toner loaded in the developing device 4*c*. The same process also proceeds in the magenta developing unit 30 and the cyan developing unit 20, forming toner images in respective colors on the photoreceptor surfaces of respective developing units.

The respective toner images formed on the photoreceptor surface are transferred one by one onto the recording paper 10 conveyed in the arrowed direction by the transfer voltage applied through the transfer rolls 70*a* to 70*c*, forming a full-color layered toner image corresponding to the original image information in cyan, magenta and yellow in that order from the top on the surface of the recording paper 10.

The image-forming apparatus whereto the image-forming process according to the invention is applied is not particularly limited, but preferably has a cstructure wherein the developing units are arranged in the order shown in FIG. 1.

Subsequently, the layered toner image formed on the recording paper 10 is conveyed to the flash fusing device 90, where it is fused by photoirradiation by the flash fusing device, forming an flash fused full-color image on the recording paper 10.

The image-forming apparatus shown in FIG. 2 has the samesructure, operation, and the like as that of the image-forming apparatus shown in FIG. 1, except that a black developing unit 50 is added to the image-forming apparatus shown in FIG. 1. The black developing unit 50 has an electrostatic charging device 1*d*, an exposure apparatus 2*d*, an electrostatic image-holding member (photoreceptor) 3*d*, and a developing device 4*d*. The image-forming apparatus in this configuration provides a full-color layered toner image in cyan, magenta, yellow and black in that order from the top.

If a black toner is used together with three color toners and the emission energy is relatively higher, an image-forming apparatus having the structure wherein the developing unit is placed in the order as shown in FIG. 2 is preferably used in the invention.

The image-forming apparatus shown in FIG. 3 has the samestructure, operation, and the like as that of the image-forming apparatus shown in FIG. 2, except that an invisible developing unit 60 is added to the image-forming apparatus shown in FIG. 2. In invisible developing unit 60, 1*e* represents an electrostatic charging device; 2*e*, an exposure apparatus; 3*e*, an electrostatic image-holding member (photoreceptor), and 4*e*, a developing device. The image-forming apparatus in this configuration provides a full-color layered toner image in cyan, magenta, yellow, black, and invisible in that order from the top.

If an invisible toner is used together with three color toners and a black toner, an image-forming apparatus having the structure wherein the developing unit is placed in the order as shown in FIG. 3 is preferably used under a certain condition in the invention.

EXAMPLES

Hereinafter, the present invention will be described more specifically with reference to Examples.

(1) Preparation of Toners

Each toner composition including the binder resin, infrared absorbent, pigment, antistatic agent, and wax shown in Table 1 is blended previously in a HENSCHEL Mixer, melt-blended in an extruder (trade name: PCM-30, manufactured by Ikegai Co. Ltd.) at 100 to 110° C. and 250 rpm, subjected to a coarse crushing by using a hammer mill, pulverized by using a jet mill, and classified in an air classifier, to obtain toner particles of each toner having a volume-average particle diameter of 6.1 to 6.5 μm.

Then, hydrophobic silica fine particles (TG820F) are added to of toner particles of each toner as an external additive (0.5 parts by mass of hydrophobic silica per 1.0 part by mass of toner particles), and the mixture is blended by using a HENSCHEL Mixer, to obtain each toner shown in Table 1 (CT-1, CT-2, MT-1, YT-1, ST-1, or BT-1).

The properties of each toner are summarized in Table 2.

| | | Infrared absorbent 1 (mass %) | Infrared absorbent 2 (mass %) | Infrared absorbent 3 (mass %) | Binder resin (part by mass) | Antistatic agent (part by mass) | Wax (part by mass) | Pigment (part by mass) Cyan pigment | Magenta pigment | Yellow pigment | Carbon black | External additive (part by mass) |
|---|---|---|---|---|---|---|---|---|---|---|---|---|
| Cyan toner | CT-1 | 0.6 | — | 1 | 93.9 | 1 | 1 | 2 | — | — | — | 0.5 |
| | CT-2 | 0.3 | — | 1 | 94.2 | 1 | 1 | 2 | — | — | — | 0.5 |
| Magenta toner | MT-1 | 0.6 | — | — | 91.9 | 1 | 1 | — | 5 | — | — | 0.5 |
| Yellow toner | YT-1 | 0.6 | — | — | 91.9 | 1 | 1 | — | — | 5 | — | 0.5 |
| Invisible toner | ST-1 | 0.1 | 0.1 | 15 | 82.3 | 1 | 1 | — | — | — | — | 0.5 |
| Black toner | BT-1 | — | — | — | 82.5 | 1 | 1 | — | — | — | 15 | 0.5 |

Magenta pigment: C.I. Pigment Vioret 19, trade name: RED E2B 70 (manufactured by Clariant)

Cyan pigment: C.I. Pigment Blue 15:3, trade name: Blue No. 4 (manufactured by Dainichiseika Color & Chemicals Mfg.)

Yellow pigment: C.I. Pigment Yellow, trade name: Paliotol Y-D1155 (manufactured by BASF)

Carbon black: trade name Nipex35 (manufactured by Degussa)

Infrared absorbent 1: naphthalocyanine, trade name: YKR5010 (manufacture by Yamamoto Chemicals Inc.)

Infrared absorbent 2: diimmonium, trade name: NIR-IM1 (manufactured by Nagase Chemlock)

Infrared absorbent 3: ytterbium oxide, trade name: UU-HP (manufactured by Shin-Etsu Chemical)

Binder resin: cycloolefin resin, trade name: TopasTM (manufactured by Ticona)

Antistatic agent: quaternary ammonium salt, trade name: P-51 (manufactured by Orient Chemical Industries, Ltd.)

Wax: polyethylene, trade name: Ceridust 2051 (manufactured by Clariant)

External additive: silica, trade name: TG820F

| | | Toner particle size distribution | | Toner shape | | Thermal properties | | Maximum absorbance in the wavelength region of 800 to 1,100 nm | Acid value |
|---|---|---|---|---|---|---|---|---|---|
| | | D50v (μm) | D50v/D50p | Average circularity | Standard deviation of circularity | Tg (° C.) | Softening point (° C.) | | (KOH mg/g) |
| Cyan toner | CT-1 | 6.2 | 1.24 | 0.956 | 0.037 | 62 | 96 | 0.84 | 12.5 |
| | CT-2 | 6.3 | 1.23 | 0.959 | 0.039 | 63 | 97 | 0.73 | 12.6 |
| Magenta toner | MT-1 | 6.3 | 1.23 | 0.957 | 0.036 | 64 | 96 | 0.83 | 12.6 |
| Yellow toner | YT-1 | 6.5 | 1.25 | 0.958 | 0.038 | 64 | 96 | 0.83 | 12.8 |
| Invisible toner | ST-1 | 6.2 | 1.22 | 0.960 | 0.036 | 63 | 97 | 0.55 | 12.6 |
| Black toner | BT-1 | 6.1 | 1.21 | 0.959 | 0.036 | 62 | 98 | 1.05 | 12.9 |

(2) Preparation of Developers

Six parts by mass of each of the toners above is added to 94 parts by mass of a carrier having a volume-average particle diameter of 60 μm, which is prepared by coating a silicone resin on the surface of a ferrite core material, and the mixture is blended in a 10-L ball mill for 2 hours, to obtain 7 kg of each two-component developer.

(3) Evaluation

Image evaluations including fixing efficiency and void resistance are carried out by using each of the developers obtained. A modified DOCUPRINT 1100CF manufactured by Fuji Xerox Co. Ltd., which has eight xenon flash lamps as a built in the flash fusing device that emit a high-intensity light in the wavelength range of 700 to 1,500 nm is used as the evaluation device. In addition, flash lights are irradiated in a delayed light emission process wherein flash lights are irradiated twice on a unit area. The delayed light emission is carried out by irradiating a light twice from four lamps having the same light energy onto the printing surface, and the delay time is 1 msec.

The recording medium used is a plain paper (trade name: NIP-1500LT, manufactured by Kobayashi Kirokushi Co., Ltd.); and an image of one inch square (2.54 cm×2.54 cm) is formed by the image-forming apparatus. More specifically, the image is formed by using cyan, magenta, yellow, black, and invisible toners; developing and transferring the image having the layer structure shown in each of Examples and Comparative Examples of Table 3; and fixing the resulting transferred image under the conditions of flash fusing emission energy respectively shown in Table 3. In Comparative Example 8, flash light is irradiated only once.

The amount of toner adhered (toner on the recording medium) is 0.6 mg/m$^2$ per color; and that of two toners, 1.2 mg/m$^2$; and the amount of the total toners is adjusted up to 1.5 mg/m$^2$ by a color management system when three toners or more are used for printing. Further, an invisible toner is not normally printed over the color toners or a monochrome toner, but may occasionally overlap the existing toner(s) due to the displacement of the image. The evaluation device is so designed that there is no problem in fixing even in such a case. The toner image is formed in the image-forming apparatus shown in FIGS. 1 to 3 wherein the developing unit for lower-layer toner is located to the right and the developing unit for upper-layer toner to the left.

Methods of evaluating the image thus obtained will be described below.

-Fixing Efficiency-

The fixing rate of an image of one inch square is evaluated as follows:

The optical density of an image (OD1) is first determined, and then the optical density (OD2) of the image after an adhesive tape (trade name: SCOTCH Mending Tape, manufactured by Sumitomo 3M Ltd.) is applied on the image and peeled off therefrom. A densitometer, X-rite 938 manufactured by X-rite, is used for determination of the optical density. The fixing rate is calculated from the optical densities thus obtained according to the following Formula (3):

$$\text{Fixing rate } (\%)=(OD2/OD1)\times 100 \quad (3)$$

It is confirmed by visual observation of the formed image that an image with favorable quality without staining in the background such as fogging is obtained. The fixing efficiency is evaluated from the fixing rate obtained above, according to the following criteria:

A: Fixing rate: 90% or more

B: Fixing rate: 80% or more and less than 90%

C: Fixing rate: 70% or more and less than 80% (barely usable)

D: Fixing rate: less than 70% (unusable)

Status A concentration is used for the optical density of the color toners.

-Voids-

The size and the number of voids (void defect) in the image of one inch square obtained are examined by visual observation under a microscope and evaluated according to the following criteria:

A: No voids

B: Ten to 50 voids of several dozen μm in diameter present (scarcely visible visually)

C: Voids of several hundred μm in diameter present (apparent defect by visual observation, causing practical problems)

-Color Reproducibility and Surface Smoothness-

The color reproducibility and the surface smoothness of the image are examined by visual observation and evaluated according to the following criteria:

A: Toners are well blended and the color reproducibility and surface smoothness of the image are superior.

B: Some toners are insufficiently blended. Practically without problem.

C: Toners are insufficiently blended, resulting in undesired color reproducibility or inferior surface smoothness. Practically problemsome.

-Fogging and Others-

The fogging, the dot reproducibility, and the thin line reproducibility of the image obtained are determined by visual observation and evaluated according to the following criteria:

A: Superior in image quality.
B: Practically no problem.
C: Practically problemsome.
The results above are summarized in Table 3.

| | Toner layer structure (layers in the order counted from recording medium surface) | | | | | Emission | Fixing | | | Color repro- | Fogging |
|---|---|---|---|---|---|---|---|---|---|---|---|
| | First layer | Second layer | Third layer | Fourth layer | Fifth layer | energy ($J/cm^2$) | rate (%) | Fixing efficiency | Void resistance | ducibility and others | and others |
| Example 1 | YT-1 | MT-1 | CT-1 | — | — | 4 | 96 | A | B | A | A |
| Example 2 | BT-1 | YT-1 | MT-1 | CT-1 | — | 1 | 71 | C | B | A | A |
| Example 3 | BT-1 | YT-1 | MT-1 | CT-1 | — | 2 | 75 | C | B | A | A |
| Example 4 | BT-1 | YT-1 | MT-1 | CT-1 | — | 3 | 86 | B | B | A | A |
| Example 5 | BT-1 | YT-1 | MT-1 | CT-1 | — | 4 | 99 | A | B | A | A |
| Example 6 | BT-1 | YT-1 | MT-1 | CT-1 | — | 7 | 100 | A | B | A | A |
| Example 7 | BT-1 | YT-1 | MT-1 | CT-2 | — | 1 | 70 | C | A | A | A |
| Example 8 | BT-1 | YT-1 | MT-1 | CT-2 | — | 2 | 73 | C | A | A | A |
| Example 9 | BT-1 | YT-1 | MT-1 | CT-2 | — | 3 | 82 | B | A | A | A |
| Example 10 | BT-1 | YT-1 | MT-1 | CT-2 | — | 4 | 95 | A | A | A | A |
| Example 11 | BT-1 | YT-1 | MT-1 | CT-2 | — | 7 | 98 | A | A | A | A |
| Example 12 | YT-1 | MT-1 | CT-2 | BT-1 | — | 1 | 80 | B | A | A | A |
| Example 13 | YT-1 | MT-1 | CT-2 | BT-1 | — | 2 | 85 | B | A | A | A |
| Example 14 | YT-1 | MT-1 | CT-2 | BT-1 | — | 3 | 90 | A | B | A | A |
| Example 15 | YT-1 | MT-1 | CT-2 | BT-1 | — | 4 | 95 | A | B | A | A |
| Example 16 | YT-1 | MT-1 | CT-2 | BT-1 | — | 7 | 100 | A | B | A | A |
| Comparative Example 1 | BT-1 | CT-1 | MT-1 | YT-1 | — | 1 | 36 | D | A | C | A |
| Comparative Example 2 | BT-1 | CT-1 | MT-1 | YT-1 | — | 2 | 40 | D | A | C | A |
| Comparative Example 3 | BT-1 | CT-1 | MT-1 | YT-1 | — | 3 | 51 | D | A | C | A |
| Comparative Example 4 | BT-1 | CT-1 | MT-1 | YT-1 | — | 4 | 64 | D | A | C | A |
| Comparative Example 5 | BT-1 | CT-1 | MT-1 | YT-1 | — | 7 | 65 | D | A | C | A |
| Comparative Example 6 | BT-1 | CT-2 | YT-1 | MT-1 | — | 4 | 66 | D | A | C | A |
| Example 17 | BT-1 | ST-1 | YT-1 | MT-1 | CT-1 | 4 | 92 | A | A | A | A |
| Comparative Example 7 | BT-1 | CT-2 | MT-1 | YT-1 | ST-1 | 4 | 59 | D | A | C | A |
| Comparative Example 8 | BT-1 | YT-1 | MT-1 | CT-1 | — | 4 (single emission) | 100 | A | C | A | A |

Table 3 reveals that the fixing efficiency of an image is slightly insufficient at an emission energy of less than 3 $J/cm^2$ in Examples 2 to 6 wherein the image is fixed from multiple toner layers having a black toner at the bottom and other toners layered in the order shown in the Table. It also reveals that the fixing efficiency is favorable at an emission energy of 3 $J/cm^2$ or more, while very minute voids are generated to a degree that causes no problems during production.

In contrast, in Comparative Examples 1 to 5 wherein an image is formed from multiple layers containing the same toners but having a yellow toner inferior in fixing efficiency in the upper layer, the toners are apparently not fixed well. As a result, the color reproducibility also declines.

In contrast, in Examples 7 to 11 wherein an image is fixed with multiple layers containing a black toner in the bottom layer and a cyan toner having an infrared absorbent in a smaller amount, void generation is suppressed in the entire energy region. The results indicate that among color toners a cyan toner containing an infrared absorbent in an amount smaller than in the other toners is effective in reducing void generation.

Further, in Examples 12 to 16 wherein an image is formed when a black toner is used as the top layer, the image is favorably fixed even at an emission energy of less than 3 $J/cm^2$ without void generation. At an emission energy of 3 $J/cm^2$ or more, the fixing efficiency remains favorable, but very minute voids are generated; however, voids are generated only to a degree that does not cause any problems in production.

On the contrary, in Comparative Example 6 wherein the same combination of toners is used and a magenta toner is used as the top layer and a cyan toner as the bottom layer, the fixing efficiency is much lower, to a practically unusable degree.

In addition, it is apparent that even if an invisible toner is used, it is possible to prevent significant impairment of the fixing of the entire image by positioning the invisible toner as the lowermost layer among the toners other than the black toner, as shown in Example 17. In contrast, in Comparative Example 7 wherein the invisible toner is formed in the top layer, the image fixing efficiency is significantly impaired when two or more color toners are layered.

In Comparative Example 8 wherein the flash fusing is not carried out by a delayed process but by a single emission, the void resistance of the image declines drastically compared to the image in Example 5 that is formed from a layered toner having a similar layer structure.

As described above, the invention provides a full-color image satisfying the requirements of both fixing efficiency and void resistance, which are normally incompatible with each other, to a sufficiently high degree, and that has superior color reproducibility, glossiness, and the like, by forming a full-color toner image by supplying color toners onto a recording medium and fixing the toner image onto a recording medium in a flash fusing device.

What is claimed is:

1. An image-forming process for forming a full-color image comprising:

forming a full-color toner image by supplying at least a cyan toner, a magenta toner and a yellow toner onto a recording medium; and fixing the toner image on the recording medium by flash fusing, wherein:

each of the cyan toner, the magenta toner and the yellow toner contains an infrared absorbent;

the cyan toner is supplied so that out of the cyan toner, the magenta toner and the yellow toner, the cyan toner is positioned in an uppermost layer in areas of the toner image where the cyan toner is present; and the flash fusing is performed by a delayed light emission process wherein a plurality of flash lamps emit lights at a time interval, wherein the content amount of the infrared absorbent in the cyan toner is smaller than the respective content amounts of the infrared absorbent in the magenta toner and the yellow toner.

2. The image-forming process according to claim 1, wherein a total emission energy of the plurality of flash lamps is in a range of 3.0 to 7.0 J/cm$^2$; the full-color image includes an image portion containing a black toner; and the black toner is supplied so that the black toner is positioned in a lowermost layer in areas of the toner image where the black toner is present.

3. The image-forming process according to claim 2, wherein the cyan toner, the magenta toner, the yellow toner and the black toner are supplied so that they are superimposed in the order of the cyan toner, magenta toner, the yellow toner and the black toner from the uppermost layer of the toner image.

4. The image-forming process according to claim 3, wherein the full-color image includes an image portion containing an invisible toner; and the cyan toner, the magenta toner, the yellow toner, the invisible toner and the black toner are supplied so that they are superimposed in the order of the cyan toner, the magenta toner, the yellow toner, the invisible toner and the black toner from the uppermost layer of the toner image.

5. The image-forming process according to claim 1, wherein the full-color image includes an image portion containing an invisible toner, and the invisible toner is supplied so that the invisible toner is positioned in a lowermost layer in areas of the toner image where the invisible toner is present.

6. The image-forming process according to claim 1, wherein the infrared absorbent is selected from a cyanine compound, a merocyanine compound, a benzene thiol-based metal complex, a mercaptophenol-based metal complex, an aromatic diamine-based metal complex, a nickel complex compound, a phthalocyanine compound, an anthraquinone compound, ytterbium oxide, ytterbium phosphate, a naphthalocyanine compound, an aminium compound, or a diimmonium compound.

7. The image-forming process according to claim 1, wherein the infrared absorbent satisfies one of the following conditions, (I) and (II):

(I) the infrared absorbent is an organic infrared absorbent, and the amount of the organic infrared absorbent added is 0.05 to 5 parts by mass with respect to 100 parts by weight of the toner; or (II) the infrared absorbent is an inorganic infrared absorbent, and the amount of the inorganic infrared absorbent added is 5 to 70 parts by mass with respect to 100 parts by mass of the toner.

8. The image-forming process according to claim 1, wherein the maximum value of an infrared ray absorbance of the cyan toner in a wavelength range of 800 to 1,100 nm is smaller than the respective maximum values of an infrared ray absorbance of the yellow toner and the magenta toner in the wavelength range of 800 to 1,100 nm.

9. The image-forming process according to claim 1, wherein a processing speed is 200 mm/sec or more.

10. The image-forming process according to claim 1, wherein a processing speed is 1,000 mm/sec or more.

11. An image-forming process for forming a full-color image comprising:

forming a full-color toner image by supplying at least a cyan toner, a magenta toner and a yellow toner onto a recording medium; and fixing the toner image on the recording medium by flash fusing, wherein:

each of the cyan toner, the magenta toner and the yellow toner contains an infrared absorbent;

the yellow toner is supplied so that out of the cyan toner, the magenta toner and the yellow toner, the yellow toner is positioned in a lowermost layer in areas of the toner image where the yellow toner is present; and the flash fusing is performed by a delayed light emission process wherein a plurality of flash lamps emit lights at a time interval, wherein the content amount of the infrared absorbent in the cyan toner is smaller than the respective content amounts of the infrared absorbent in the magenta toner and the yellow toner.

12. The image-forming process according to claim 11, wherein a total emission energy of the plurality of flash lamps is 1.0 J/cm$^2$ or more and less than 3.0 J/cm$^2$; the full-color image includes an image layer containing a black toner; and the black toner is supplied so that the black toner is positioned in an uppermost layer in areas of the toner image where the black toner is present.

13. The image-forming process according to claim 12, wherein the black toner, the cyan toner, the magenta toner and the yellow toner are supplied so that they are superimposed in the order of the black toner, the cyan toner, the magenta toner and the yellow toner from the uppermost layer of the toner image.

14. The image-forming process according to claim 13, wherein the full-color image includes an image portion containing an invisible toner; and the black toner, the cyan toner, the magenta toner, the yellow toner and the invisible toner are supplied so that they are superimposed in the order of the black toner, the cyan toner, the magenta toner, the yellow toner and the invisible toner from the uppermost layer of the toner image.

15. The image-forming process according to claim 11, wherein the full-color image includes an image portion containing an invisible toner; and the invisible toner is supplied so that the invisible toner is positioned in the lowermost layer in areas of the toner image where the invisible toner is present.

16. The image-forming process according to claim 11, wherein the infrared absorbent is selected from a cyanine compound, a merocyanine compound, a benzene thiol-based metal complex, a mercaptophenol-based metal complex, an aromatic diamine-based metal complex, a nickel complex compound, a phthalocyanine compound, an anthraquinone compound, ytterbium oxide, ytterbium phosphate, a naphthalocyanine compound, an aminium compound, or a diimmonium compound.

17. The image-forming process according to claim 11, wherein the infrared absorbent satisfies one of the following conditions, (I) and (II):

(I) the infrared absorbent is an organic infrared absorbent, and the amount of the organic infrared absorbent added is 0.05 to 5 parts by mass with respect to 100 parts by mass of the toner; and (II) the infrared absorbent is an inorganic infrared absorbent, and the amount of the inorganic infrared absorbent added is 5 to 70 parts by mass with respect to 100 parts by mass of the toner.

18. The image-forming process according to claim 11, wherein the maximum value of an infrared ray absorbance of the cyan toner in a wavelength range of 800 to 1,100 nm is smaller than the respective maximum values of an infrared ray absorbance of the yellow toner and the magenta toner in the wavelength range of 800 to 1,100 nm.

19. The image-forming process according to claim 11, wherein a processing speed is 200 mm/sec or more.

20. The image-forming process according to claim 11, wherein a processing speed is 1,000 mm/sec or more.

21. An image-forming apparatus for forming a full-color toner image, comprising:

a toner image-forming device for forming a full-color toner image by supplying at least a cyan toner, a magenta toner and a yellow toner onto a recording medium; and an image fixing device for fixing the toner image on the recording medium by flash fusing, wherein:

each of the cyan toner, the magenta toner and the yellow toner contains an infrared absorbent;

the toner image-forming device supplies the toners so that out of the cyan toner, the magenta toner and the yellow toner, the cyan toner is positioned in an uppermost layer in areas of the toner image where the cyan toner is present; and the image fixing device is a flash fusing device having a plurality of flash lamps capable of flash fusing by a delayed light emission process of emitting lights from the plurality of flash lamps at a time interval, wherein the content amount of the infrared absorbent in the cyan toner is smaller than the respective content amounts of the infrared absorbent in the magenta toner and the yellow toner.

22. An image-forming apparatus for forming a full-color toner image, comprising:

a toner image-forming device for forming a full-color toner image by supplying at least a cyan toner, a magenta toner and a yellow toner onto a recording medium; and an image fixing device for fixing the toner image on the recording medium by flash fusing, wherein:

each of the cyan toner, the magenta toner and the yellow toner contains an infrared absorbent;

the toner image-forming device supplies the toners so that out of the cyan toner, the magenta toner and the yellow toner, the yellow toner is positioned in a lowermost layer in areas of the toner image where the yellow toner is present; and the image fixing device is a flash fusing device having a plurality of flash lamps capable of flash fusing by a delayed light emission process of emitting lights from the plurality of flash lamps at a time interval, wherein the content amount of the infrared absorbent in the cyan toner is smaller than the respective content amounts of the infrared absorbent in the magenta toner and the yellow toner.

* * * * *